US007976720B2

(12) United States Patent
Sakamoto

(10) Patent No.: US 7,976,720 B2
(45) Date of Patent: Jul. 12, 2011

(54) COMPOSITE MAGNETIC SHEET AND PRODUCTION METHOD THEREOF

(75) Inventor: Shinichi Sakamoto, Tokyo (JP)

(73) Assignee: Sumida Corporation, Tokyo (JP)

( * ) Notice: Subject to any disclaimer, the term of this patent is extended or adjusted under 35 U.S.C. 154(b) by 628 days.

(21) Appl. No.: 11/672,796

(22) Filed: Feb. 8, 2007

(65) Prior Publication Data

US 2007/0190360 A1 Aug. 16, 2007

(30) Foreign Application Priority Data

Feb. 14, 2006 (JP) ..... 2006-037004

(51) Int. Cl.
*H01F 1/24* (2006.01)

(52) U.S. Cl. ..... 252/62.54; 264/108; 264/129; 264/132; 264/133; 264/175; 264/204

(58) Field of Classification Search ..... 252/62.54, 252/62.55; 264/108, 129, 132, 133, 175, 264/204

See application file for complete search history.

(56) References Cited

U.S. PATENT DOCUMENTS

| | | | | |
|---|---|---|---|---|
| 2,367,358 | A * | 1/1945 | Kott et al. | 75/243 |
| 3,152,082 | A * | 10/1964 | Davis et al. | 252/62.54 |
| 3,324,541 | A | 6/1967 | Luiten et. al. | |
| 5,767,426 | A * | 6/1998 | Oliver et al. | 75/246 |
| 5,982,073 | A * | 11/1999 | Lashmore et al. | 310/216.001 |
| 2004/0140447 | A1 * | 7/2004 | Kintz et al. | 252/62.52 |

FOREIGN PATENT DOCUMENTS

| | | | |
|---|---|---|---|
| GB | 837198 | * | 6/1960 |
| GB | 837199 | * | 6/1960 |
| GB | 863127 | * | 3/1961 |
| JP | 6-333743 | | 12/1994 |
| JP | 2004-247663 | | 9/2004 |

OTHER PUBLICATIONS

Tattam et al, "The use of polytetrafluoroethylene in the production of high-density bonded Nd-Fe-B magnets", Jorn. App Phys., 76, Part 2, No. 10, Nov. 15, 1994.*

C. Tattam, et. al. "The use of polytetrafluoroethyleve in the production of high-density bonded ND-FE-B Magnets" Journalof Applied Physics 76 Nov. 15, 1994, Part 2, No. 1.

* cited by examiner

*Primary Examiner* — C. Melissa Koslow
(74) *Attorney, Agent, or Firm* — Stephen M. Chin, Esq.

(57) ABSTRACT

The present invention provides a composite magnetic sheet having a high magnetic permeability, to be produced easily at a low cost. The composite magnetic sheet includes magnetic substance powders and polytetrafluoroethylene powders.

2 Claims, 4 Drawing Sheets

PRIOR ART

COMPOSITE MAGNETIC SHEET AND PRODUCTION METHOD THEREOF

CLAIM OF PRIORITY

This application claims the benefit of Japanese Patent Application No. 2006-037004 filed on Feb. 14, 2006, the entire contents of which are hereby incorporated by reference herein.

BACKGROUND OF THE INVENTION

1. Field of the Invention

The present invention relates to a composite magnetic sheet preferable for a magnetic part for a coil, and a production method thereof.

2. Description of the Related Art

Recently, with the trend of a thinner shape, a smaller size and a higher density implementation of electronic appliances, or a substrate structure of a multiple layer arrangement, or the like, a smaller size, a lower height and a thinner shape of magnetic parts such as coil parts to be mounted on the electronic appliances are more and more required. Additionally, to the coil parts used for a power source circuit, a higher performance concerning the electric characteristics for dealing with a high electric current, or the like and cost reduction of the magnetic parts are also highly required.

Conventionally, the magnetic parts used for the coil parts have been produced for example by a method as follows. First, a paste is prepared by mixing ferrite magnetic substance powders with a binder, a solvent, or the like for forming a thin magnetic sheet of a 10 to 100 μm thickness. Then, the magnetic sheet is provided with a conductor line path or a connecting electrode on its surface and a plurality of resultant sheets are laminated. A laminated body of the magnetic sheets is pressed with a pressing machine as a magnetic member for the coil parts and then baked integrally in a baking furnace. Thereafter, an external electrode is formed on a side end face of the sintered compact for providing a laminated chip coil (see, for example, Japanese Patent Application Laid-Open No. 1994-333743, paragraph number 0010, FIG. 1).

Moreover, a production method as follows is also employed. Powders prepared by covering the surface of flat metal magnetic powders with an insulating layer are added to a resin material so as to be mixed and dispersed sufficiently in an organic solvent. Subsequently, a coating film is formed by applying the above-mentioned slurry onto a supporting member. Thereafter, by carrying out the in-plane alignment process by adjusting the magnetic field intensity, the coating film is dried so as to produce a composite magnetic sheet (see, for example, Japanese Patent Application Laid-Open No. 2004-247663, paragraph numbers 0009 to 0036, FIG. 1).

However, the above-mentioned conventional magnetic parts involve the following problems. The magnetic sheet disclosed in Japanese Patent Application Laid-Open No. 1994-333743 is preferable for a part of a low-height-type laminated chip coil. However, the magnetic sheet is produced by wet mixing of magnetic substance powders mainly made of a Ni—Cu—Zn based ferrite, or the like, and a binder made of a mixture of a resin and an organic solvent, or the like, and forming a coating film of the obtained slurry and executing a drying process. Furthermore, since a sintering process is essential in order to obtain preferable magnetic characteristics as a magnetic core for a coil part, the production processes and the time are prolonged and the cost is raised, and thus it is problematic.

Moreover, the composite magnetic sheet disclosed in Japanese Patent Application Laid-Open No. 2004-247663 is suitable for an inductance element to be mounted on a printed wiring board. However, since the composite magnetic sheet is also produced by wet mixing of magnetic substance powders, and a binder of a mixture of a resin and an organic solvent, or the like, and forming a coating film of the obtained slurry and executing a drying process, the substantial production process of the magnetic sheet, the conditions, the elements, or the like required therefor are same as those of Japanese Patent Application Laid-Open No. 1994-333743 so that the problems of the time and the cost rise remain. Moreover, since the effective magnetic permeability μ of a composite magnetic sheet tends to be low due to the factors such as decline of the effective filling ratio of the magnetic substance powders derived from voids generated by evaporation of the solvent at the time of drying the composite magnetic sheet after coating, and the low magnetic permeability μ in general of the metal based magnetic substance powders used mainly for the composite magnetic sheet compared with the ferrite based magnetic substance powders, the filling ratio of the magnetic substance powders in the composite magnetic sheet needs to be increased by using metal based magnetic substance powders of a flat shape, including a large amount of metal based magnetic substance powders as much as possible, or the like. However, in the case that the addition amount of a resin and a solvent, which provides the flexibility and the bonding property, is reduced, since the vulnerability of the magnetic sheet becomes remarkable, the amount of the metal magnetic substance powders to be added has its limit so that an obtainable magnetic permeability is limited as well.

SUMMARY OF THE INVENTION

The present invention has been achieved in order to solve the above-mentioned problems, and an object thereof is to provide a composite magnetic sheet having a high magnetic permeability, to be produced easily at a low cost, and a production method thereof.

In order to achieve the above-mentioned object, the present invention provides a composite magnetic sheet including magnetic substance powders and a compact made of polytetrafluoroethylene powders.

According to the composite magnetic sheet of such a configuration, the excellent magnetic characteristics can be maintained. The magnetic permeability of a composite magnetic sheet largely depends on the magnetic characteristics of the magnetic substance powders included in the sheet and the filling amount of the magnetic substance powders. Since the polytetrafluoroethylene powders are used, they can be mixed with the magnetic substance powders by a dry process. Therefore, unlike the wet process mixing, the problems of the residual voids generated by the volatilization of the solvent and a lower density derived therefrom don't occur. Therefore, since the magnetic substance powders and the polytetrafluoroethylene powders can be filled by a high density so that the volume of the residual voids in the composite magnetic sheet can be extremely low. As a result, the magnetic characteristics of the composite magnetic sheet can be improved. Moreover, since a polytetrafluoroethylene (PTFE) chemically stable and having the excellent corrosion resistance and heat resistance is used, the heat resistance and the high humidity resistance of the composite magnetic sheet can be improved.

Moreover, the present invention provides a composite magnetic sheet using magnetic substance powders of an iron based alloy as the magnetic substance powders.

Furthermore, the present invention provides a composite magnetic sheet using spherical powders as the magnetic substance powders.

Moreover, the present invention provides a composite magnetic sheet using flat powders as the magnetic substance powders.

Furthermore, the present invention provides a composite magnetic sheet with the content ratio of the magnetic substance powders of 85% by weight or more with respect to the composite magnetic sheet.

Moreover, the present invention provides a composite magnetic sheet with the density of 3.5 g/cm$^3$ or more.

Moreover, another aspect of the present invention provides a production method of a composite magnetic sheet including magnetic substance powders and polytetrafluoroethylene powders, including a powder mixing process of mixing the magnetic substance powders and the polytetrafluoroethylene powders, and a pressure shaping process of shaping the powder mixture after the powder mixing process by pressuring.

By using the production method, a composite magnetic sheet having a high magnetic permeability can be produced easily at a low cost. In the case that a powder mixture of the magnetic substance powders and the polytetrafluoroethylene (PTFE) powders is pressured, the polytetrafluoroethylene (PTFE) powders provide a compact having a network structure by pressuring. The magnetic substance powders enter into the gap portions of the network structure by shaping. Therefore, not only the filling amount of the magnetic substance powders can be made higher but also the risk of elution of the magnetic substance powders from the polytetrafluoroethylene (PTFE) is low. Moreover, since two kinds of the powders are mixed by a dry process without use of a solvent, a problem of the residual voids generated by the volatilization of the solvent and the low density derived therefrom cannot be generated. Therefore, a composite magnetic sheet capable of realizing the process simplification, and having the desired magnetic characteristics and high strength can be produced.

Moreover, the present invention provides a production method of a composite magnetic sheet, including a powder mixing process of mixing the magnetic substance powders and the polytetrafluoroethylene powders, a pressure shaping process of shaping the powder mixture after the powder mixing process by pressuring, and a re-pressure shaping process of pressuring again the composite magnetic sheet after the pressure shaping process.

Moreover, the present invention provides a production method of a composite magnetic sheet, wherein the pressure shaping process is roll shaping.

Furthermore, the present invention provides a production method of a composite magnetic sheet, wherein the rotational rate of one of the rolling rollers is different from the rotational rate of the other rolling roller in the roll shaping.

As the magnetic substance powders included in the composite magnetic sheet according to the present invention, in addition to the iron-silicon based alloy, metal based magnetic substance powders of an iron-nickel based alloy, an iron-silicon-aluminum based alloy, an iron, an aluminum, a platinum, a zinc, a titanium, an iron group nano crystalline substance, or the like can be used preferably.

Moreover, in some cases, sintered ferrite powders or calcinated ferrite powders of nickel-zinc based, manganese-zinc based, nickel-copper-zinc based, manganese-magnesium-zinc based, or the like can also be used. However, the above-mentioned magnetic substance powders are merely examples, and other magnetic substance powders may be used. The magnetic substance powders may either be powders of one kind or a powder mixture of two or more kinds. As to the shape of the magnetic substance powders, not only spherical but also flat, needle-like, or the like can be used. Among these examples, flat magnetic substance powders are preferable. As the magnetic substance powders, powders having a kind of shape may be used, or powders having two or more kinds of shapes may be used as well.

According to the present invention, a composite magnetic sheet having a high magnetic permeability, to be produced easily at a low cost, and a production method thereof can be provided.

DESCRIPTION OF PREFERRED EMBODIMENTS

Hereinafter, preferable embodiments of a composite magnetic sheet and a production method thereof according to the present invention will be explained in detail with reference to the drawings. However, the present invention is not limited to the preferable embodiments to be explained hereafter.

Figure 1A:
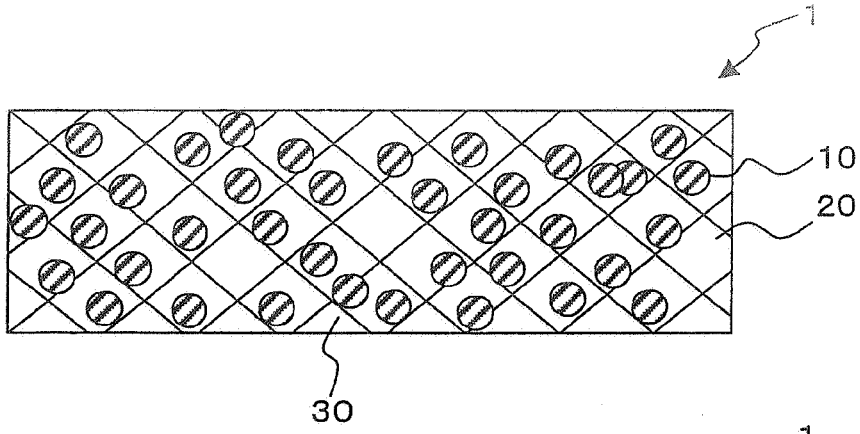
FIGS. 1A and 1B are schematic cross-sectional views of a composite magnetic sheet according to an embodiment of the present invention.
Figure 1B:
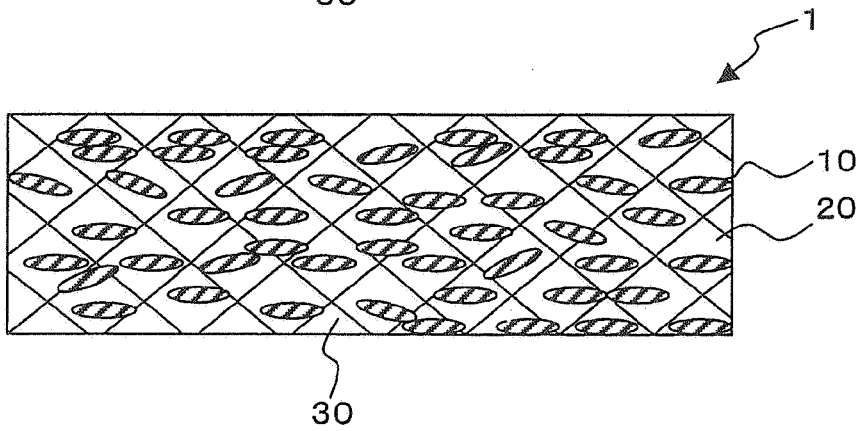

FIGS. 1A and 1B are diagrams schematically showing a cross-section of a composite magnetic sheet 1 according to an embodiment of the present invention. In FIGS. 1A and 1B, the longer side direction represents the longitudinal direction of the sheet, and the shorter side direction represents the sheet thickness direction, respectively. FIG. 1A shows a sheet produced with spherical magnetic substance powders, and FIG. 1B shows a sheet produced with flat magnetic substance powders, respectively.

As shown in FIG. 1A, the composite magnetic sheet 1 is a sheet having a structure with magnetic substance powders 10 taken in gap portions 30 of a network structure of a pressured compact made of polytetrafluoroethylene (PTFE) powders 20. The magnetic substance powders 10 are powders of a substantially spherical shape. As shown in FIG. 1B, as the magnetic substance powders 10, flat powders having a longer axis and a shorter axis may be used. In this case, compared with the case of the spherical powders, the filling ratio of the magnetic substance powders can further be made higher. Thereby, the effective magnetic permeability ($\mu$) of the composite magnetic sheet can be improved. Moreover, the composite magnetic sheet 1 has a density in a range of 3.5 g/cm$^3$ or more, preferably 3.8 g/cm$^3$ or more and 5.0 g/cm$^3$ or less. By increasing the density of the composite magnetic sheet, desired inductance or impedance values can easily be obtained in the case of being used as a magnetic core for a coil part. Here, the "density" denotes the value obtained by dividing the weight of the composite magnetic sheet 1 by the volume of the composite magnetic sheet 1.

The magnetic substance powders 10 used in this embodiment are metal based magnetic substance powders of an iron-silicon based alloy. Moreover, the content ratio of the magnetic substance powders 10 is preferably 85% by weight or more with respect to the composite magnetic sheet 1, it is more preferably in a range of 90% by weight or more and 98% by weight or less with respect to the composite magnetic sheet 1. Since the content ratio of the magnetic substance powders 10 is 85% by weight or more with respect to the composite magnetic sheet 1, the effective filling ratio of the magnetic substance powders 10 can be maintained at a high level. Therefore, a composite magnetic sheet 1 having the excellent magnetic characteristics can be provided.

The polytetrafluoroethylene (PTFE) powders 20 used in this embodiment are a kind of a fluorine resin having the excellent characteristics such as the corrosion resistance and the heat resistance. Moreover, since a network structure can be formed in the pressure compact by pressuring/rolling the polytetrafluoroethylene (PTFE) powders 20, the magnetic substance powders 10 are introduced into the gap portions 30 of the network structure. As a result, a composite magnetic sheet 1 having a high density can be produced as well as the filling ratio of the magnetic powders 10 can be made higher. As a result, a composite magnetic sheet having a high magnetic permeability (μ) can be obtained.

Figure 2:
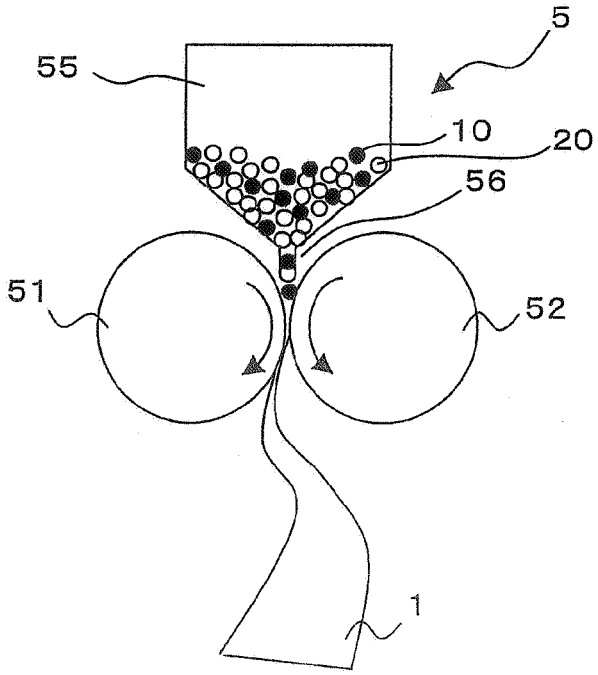
FIG. 2 is a schematic configuration diagram of a composite magnetic sheet production apparatus to be used for a part of a production process for a composite magnetic sheet according to an embodiment of the present invention.

FIG. 2 is a schematic configuration diagram of a composite magnetic sheet production apparatus 5 to be used for a part of the production process for a composite magnetic sheet 1 according to an embodiment of the present invention.

As shown in FIG. 2, the composite magnetic sheet production apparatus 5 includes two rolling rollers 51, 52 provided parallel and horizontally, and an inlet container 55 for supplying a powder mixture, disposed above the gap of the rolling roller 51 and the rolling roller 52. The rolling roller 51 is disposed facing the rolling roller 52 such that they are controlled so as to be rotated independently of each other in the opposite directions. Moreover, at the time of producing the composite magnetic sheet 1, they can be controlled so as to be rotated independently at a predetermined rate for providing a shearing force to the sheet material. The gap between the rolling roller 51 and the rolling roller 52 can be set optionally, and thereby the thickness of the composite magnetic sheet 1 can be changed optionally.

The inlet container 55 is a container for introducing a preliminarily produced mixture of the magnetic substance powders 10 and the polytetrafluoroethylene (PTFE) powders 20. The inlet container 55 is provided with a supply opening 56 in a lower part with a control mechanism provided to the supply opening 56 for changing the supply amount of the mixed powder.

By using the composite magnetic sheet production apparatus 5, the mixture of the magnetic substance powders 10 and the polytetrafluoroethylene (PTFE) powders 20 supplied from the inlet container 55 to the downward direction is rolled at the gap between the rolling roller 51 and the rolling roller 52 so as to provide a composite magnetic sheet 1. Here, with the premise that the magnetic substance powders 10 are introduced by a sufficient amount, the thickness of the composite magnetic sheet 1 can be adjusted/controlled by the administration of the gap between the rolling roller 51 and the rolling roller 52. That is, by enlarging the inter-roller distance between the rolling roller 51 and the rolling roller 52, the thickness of the composite magnetic sheet 1 to be obtained becomes thicker, and by reducing the inter-roller distance between the rolling roller 51 and the rolling roller 52, the thickness of the composite magnetic sheet 1 to be obtained becomes thinner as well. Furthermore, since the shearing force applied to the polytetrafluoroethylene (PTFE) powders 20 can be adjusted/controlled by relatively adjusting the rotational rate of the rolling roller 51 and the rotational rate of the rolling roller 52, the network structure of the polytetrafluoroethylene (PTFE) powders 20 can be changed as well as the amount of the magnetic substance powders 10 to be taken into the network structure can also be adjusted/controlled. Therefore, the density of the composite magnetic sheet 1 and the magnetic permeability μ, or the like can also be adjusted/controlled. For example, since a strong shearing force is applied to the polytetrafluoroethylene (PTFE) powders 20 by increasing the rotational rate ratio of the rolling roller 51 and the rolling roller 52, the space in the network structure is enlarged so that a large amount of the magnetic substance powders can be taken in with a small amount of the polytetrafluoroethylene (PTFE) powders so as to obtain a composite magnetic sheet having a high magnetic permeability μ. On the other hand, by reducing the rotational rate ratio of the rolling roller 51 and the rolling roller 52, although the shearing force applied to the polytetrafluoroethylene (PTFE) powders 20 is small, a minute network structure is provided so that the strength of the composite magnetic sheet 1 is improved. Accordingly, by adjusting the inter-roller distance of the rolling rollers and the rate ratio, the physical properties of the composite magnetic sheet 1 such as the thickness, the density, the strength, and the magnetic permeability μ can be adjusted.

Next, the production process for the composite magnetic sheet 1 of the embodiment of the present invention will be explained.

Figure 3:
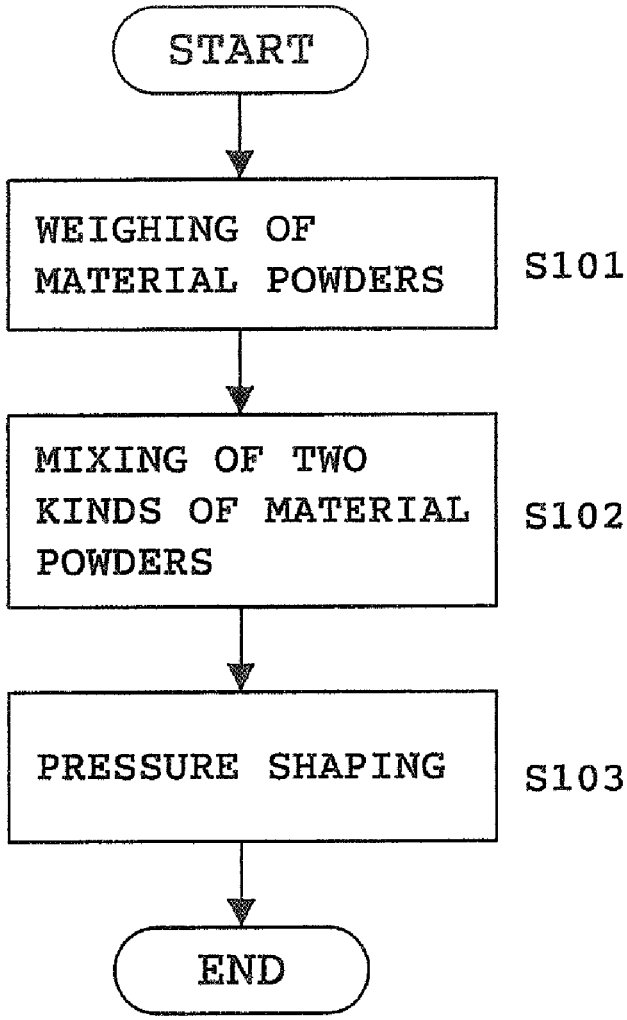
FIG. 3 is a flowchart showing a production process for a composite magnetic sheet according to an embodiment of the present invention.

FIG. 3 is a flowchart showing the production process for the composite magnetic sheet 1 according to the embodiment of the present invention.

First, the magnetic substance powders 10 and the polytetrafluoroethylene (PTFE) powders 20 to be used for the composite magnetic sheet 1 are each weighed so as to have a desired weight ratio (step S101). In this embodiment, as the polytetrafluoroethylene (PTFE) powders 20, one having 2.22 specific gravity and about 550 μm average particle size can be used preferably. Moreover, as the magnetic substance powders 10, metal based magnetic substance powders containing iron-silicon as the main component can preferably be used.

The weight ratio of the magnetic substance powders 10 is preferably 85% by weight or more with respect to the composite magnetic sheet 1, and it is more preferably in a range of 90% by weight or more and 98% or less with respect to the composite magnetic sheet 1. According to the ratio, the strength and the flexibility of the composite magnetic sheet 1 can be provided preferably as well as the magnetic characteristics, in particular, the magnetic permeability can further be improved. With the weight ratio of 85% by weight or more, owing to the high filling ratio of the magnetic substance powders 10, sufficient magnetic characteristics can be obtained. In the case of the weight ratio of 98% by weight or less, since the magnetic substance powders 10 and the polytetrafluoroethylene (PTFE) powders 20 can evenly be mixed so that the strength and the flexibility of the composite magnetic sheet 1 to be shaped can preferably be maintained. The shape of the magnetic substance powders 10 is substantially spherical, and it is more preferably flat. By use of flat magnetic substance powders 10, the magnetic substance powders 10 are bonded by the polytetrafluoroethylene (PTFE) powders 20 with each other as well as they can easily be oriented with their flat surfaces aligned in the in-plane direction of the sheet. As a result, the anti-magnetic field function of the magnetic substance powders 10 with each other is reduced so as to further improve the magnetic permeability of the composite magnetic sheet 1.

Next, a mixed powder is prepared by mixing the weighed magnetic substance powders 10 and polytetrafluoroethylene (PTFE) powders 20 using a mixing machine (step S102: powder mixing process). In this embodiment, for evenly mixing each material powder, a rotation V-type mixing device can preferably be used. However, the above-mentioned mixing method is merely an example, and other mixing methods may be used as long as it is a means capable of evenly mixing and dispersing the material powders.

Next, the mixed powder is rolled using the composite magnetic sheet production apparatus 5 so as to be shaped in a sheet-like shape (step S103: pressure shaping process). In this embodiment, the rolling roller 51 and the rolling roller 52 are disposed with an interval close to the thickness of the composite magnetic sheet 1 provided therebetween. The rotation directions of the two rolling rollers 51, 52 are in the opposite directions, and the rotational rate ratio thereof is 2:3. The mixture of the magnetic substance powders 10 and the polytetrafluoroethylene (PTFE) powders 20 is supplied continuously from the supply opening 56 of the inlet container 55 disposed above the gap between the two rolling rollers 51, 52 rotating at different rotational rates. The mixed powder is rolled at the time of passing by the gap between the rolling rollers 51, 52 as well as the shearing force is applied thereto. Therefore, the polytetrafluoroethylene (PTFE) powders 20 form a network structure and at the same time the magnetic substance powders 10 enter into the gap portions 30 of the network structure. Accordingly, a composite magnetic sheet 1 having a predetermined thickness can be formed.

The rotational velocities of the rolling rollers 51, 52 are not particularly limited, and they can be adjusted according to the thickness of the composite magnetic sheet 1. Moreover, although the two roller rolling method is adopted as the rolling method in this embodiment, as the rolling method, another method such as the calendar roll method can be used as well. However, the above-mentioned rolling method is merely an example, and a rolling method other than the above-mentioned may be used.

As heretofore mentioned, an embodiment of the composite magnetic sheet according to the present invention and the production method thereof have been explained, however, the composite magnetic sheet according to the present invention and the production method thereof are not limited to the above-mentioned embodiment, and they can be implemented in various modified embodiments.

Figure 4:
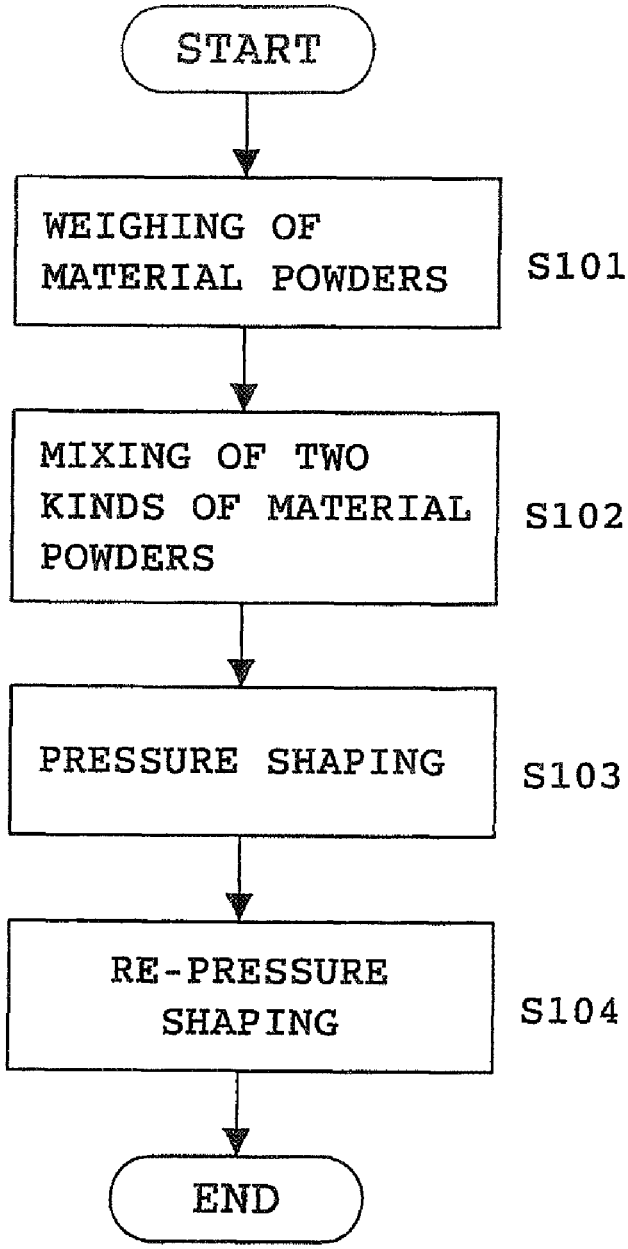
FIG. 4 is a flowchart showing a production process for a composite magnetic sheet according to another embodiment of the present invention.

For obtaining a composite magnetic sheet 1 with a high magnetic permeability, it is effective to raise the density of the composite magnetic sheet 1. As shown in FIG. 4, by carrying out a pressure shaping process (for example by carrying out a re-pressuring process using a pressing machine) (step S104: pressure shaping process) again to the composite magnetic sheet 1 obtained by the above-mentioned production processes (step S101 to step S103), a further high density can be realized. The reason thereof is that air reservoirs present in the composite magnetic sheet 1, that is, the voids can be eliminated. Compared with the case of pressuring only by one time with the two roller rolling method, the filling amount of the magnetic substance powders 10 can further be raised so that a composite magnetic sheet having high magnetic characteristics can be obtained.

EXAMPLES

Next, the examples and the comparative examples of the present invention will be explained. However, the present invention is not limited by the examples to be presented hereafter.

A. Production Procedure for the Composite Magnetic Sheet

The table 1 shows the production conditions and the evaluation results of the examples and the comparative examples.

TABLE 1

| Evaluation discussion results | | Example 1 | Example 2 | Example 3 | Example 4 | Example 5 | Example 6 | Example 7 |
|---|---|---|---|---|---|---|---|---|
| Re-pressured or not | | No | No | No | No | No | Yes | Yes |
| Mixing ratio (wt %) | Magnetic substance powders | 85 | 90 | 93 | 97 | 98 | 85 | 90 |
| | PTFE powders | 15 | 10 | 7 | 3 | 2 | 15 | 10 |
| | Binder | — | — | — | — | — | — | — |
| Density | Sheet (g/cm$^3$) | 3.4 | 3.8 | 4.1 | 4.8 | 4.9 | 4.2 | 4.2 |
| | Change (times) by re-pressuring | — | — | — | — | — | 1.2 compared with the example 1 | 1.1 compared with the example 2 |
| Volume occupation ratio (%) | Magnetic substance powders | 39.1 | 46.7 | 52.3 | 62.2 | 65.6 | 47.7 | 51.6 |
| | Voids | 37.7 | 35.8 | 34.9 | 30.8 | 30.9 | 24.0 | 29.1 |
| | Change by re-pressuring | — | — | — | — | — | −36.4 compared with the example 1 | −18.8 compared with the example 2 |
| Magnetic permeability | at 1 MHz | 8.7 | 10.2 | 11.5 | 15.9 | 18.0 | 14.2 | 15.8 |
| | change by re-pressuring (times) | — | — | — | — | — | 1.6 compared with the example 1 | 1.5 compared with the example 2 |
| Sheet physical properties (excellent/good) | External appearance | Excellent | Excellent | Excellent | Excellent | Excellent | Excellent | Excellent |
| | Flexibility | Excellent | Excellent | Excellent | Excellent | good | Excellent | Excellent |
| | Strength | Excellent | Excellent | Excellent | good | good | Excellent | Excellent |
| | Plane property | Excellent | Excellent | Excellent | Excellent | Excellent | Excellent | Excellent |

TABLE 1-continued

| Evaluation discussion results | | Example 8 | Example 9 | Example 10 | Comparative example 1 | Comparative example 2 |
|---|---|---|---|---|---|---|
| Re-pressured or not | | Yes | Yes | Yes | No | Yes |
| Mixing ratio (wt %) | Magnetic substance powders | 93 | 97 | 98 | 83 | 83 |
| | PTFE powders | 7 | 3 | 2 | — | — |
| | Binder | — | — | — | 17 | 17 |
| Density | Sheet (g/cm$^3$) | 4.5 | 4.8 | 5.0 | 2.9 | 3.0 |
| | Change (times) by re-pressuring | 1.1 compared with the example 3 | 1.0 compared with the example 4 | 1.0 compared with the example 5 | — | 1.0 compared with the comparative example 1 |
| Volume occupation ratio (%) | Magnetic substance powders | 56.1 | 63.0 | 66.3 | 33.1 | 33.8 |
| | Voids | 30.2 | 29.9 | 30.2 | 44.1 | 42.9 |
| | Change by re-pressuring | −13.5 compared with the example 3 | −3.1 compared with the example 4 | −2.2 compared with the example 5 | — | 1.0 compared with the comparative example 1 |
| Magnetic permeability | at 1 MHz | 17.5 | 18.3 | 19.2 | 5.1 | 5.1 |
| | change by re-pressuring (times) | 1.5 compared with the example 3 | 1.2 compared with the example 4 | 1.1 compared with the example 5 | — | 1.0 compared with the comparative example 1 |
| Sheet physical properties (excellent/good) | External appearance | Excellent | Excellent | Excellent | Excellent | Excellent |
| | Flexibility | Excellent | Excellent | good | Excellent | Excellent |
| | Strength | Excellent | Excellent | good | Excellent | Excellent |
| | Plane property | Excellent | Excellent | Excellent | Excellent | Excellent |

Example 1

As shown in the table 1, 85% by weight of iron based amorphous powders containing iron-silicon as the main component, having particle sizes in a range of 30 μm or more and 250 μm or less, and 15% by weight of PTFE powders having a 2.22 specific gravity and an average particle size of about 550 μm were introduced in a rotation V-type mixing device having about a 200 cc capacity. With the rotational velocity of the mixing device set at 120 rpm and the mixing time at 30 min, an even mixed powder was obtained. Next, the above-mentioned mixture was supplied from above two rolling rollers rotating at different rotational velocities by the two rolling roller method. The rotational velocity of one of the rolling rollers was set at 10 rpm and the rotational velocity of another rolling roller was set at 15 rpm. Thereby, a composite magnetic sheet was shaped.

Example 2

In the same conditions as in the example 1 except that the amounts of the magnetic powders and the PTFE powders used were changed to 90% by weight and 10% by weight, respectively with respect to the composite magnetic sheet to be obtained, production was carried out.

Example 3

In the same conditions as in the example 1 except that the amounts of the magnetic powders and the PTFE powders used were changed to 93% by weight and 7% by weight, respectively with respect to the composite magnetic sheet to be obtained, production was carried out.

Example 4

In the same conditions as in the example 1 except that the amounts of the magnetic powders and the PTFE powders used were changed to 97% by weight and 3% by weight, respectively with respect to the composite magnetic sheet to be obtained, production was carried out.

Example 5

In the same conditions as in the example 1 except that the amounts of the magnetic powders and the PTFE powders used were changed to 98% by weight and 2% by weight, respectively with respect to the composite magnetic sheet to be obtained, production was carried out.

Example 6

The re-pressuring process was applied to the composite magnetic sheet obtained in the example 1 using a pressing machine.

Example 7

The re-pressuring process was applied to the composite magnetic sheet obtained in the example 2 using a pressing machine.

Example 8

The re-pressuring process was applied to the composite magnetic sheet obtained in the example 3 using a pressing machine.

Example 9

The re-pressuring process was applied to the composite magnetic sheet obtained in the example 4 using a pressing machine.

Example 10

The re-pressuring process was applied to the composite magnetic sheet obtained in the example 5 using a pressing machine.

Comparative Example 1

Figure 5:
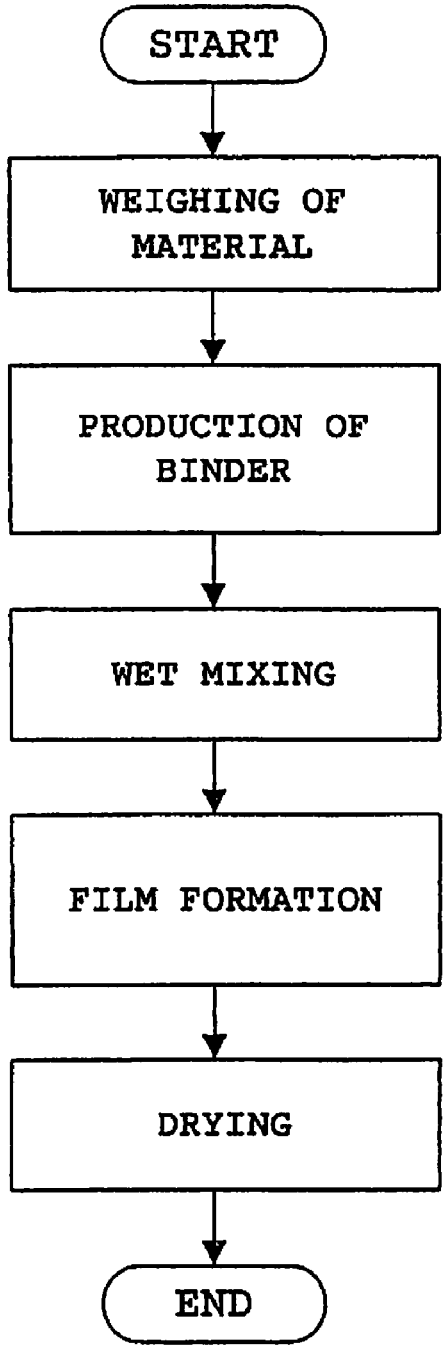
FIG. 5 is a flowchart showing a production process for a conventional composite magnetic sheet used in the comparative examples.

A composite magnetic sheet was obtained by the conventional production method shown in FIG. 5 as a conventional composite magnetic sheet similar to Japanese Patent Application Laid-Open No. 2004-247663 with the amounts of the magnetic substance powders and the binder made of a polyvinyl butylal based resin and a solvent provided to 83% by weight and 17% by weight, respectively with respect to the composite magnetic sheet to be obtained.

Comparative Example 2

The re-pressuring process was applied to the composite magnetic sheet obtained in the comparative example 1 using a pressing machine.

B. Characteristic Evaluation Method of the Composite Magnetic Sheets

The external and the flatness degree of the obtained composite magnetic sheets were examined by visual observation. Moreover, by bending the composite magnetic sheets, the flexibility and the strength of the composite magnetic sheets were examined. In the external appearance evaluation, a state without a defect at all was evaluated as "excellent" and a state with a minor defect without a problem in use as "good". In the plane property evaluation, a substantially plane state was evaluated as "excellent" and a state with slight ruggedness without a problem in use as "good". In the flexibility evaluation, a state of restoring to the original state without breakage, or the like by bending was evaluated as "excellent" and a state with slight resistance at the time of bending without a problem in use as "good". As to the strength evaluation, a composite magnetic sheet square test piece of 2 mm×2 mm×20 mm was prepared for a 3 point bonding test of applying a load in the central part with both ends fixed for evaluation in terms of whether or not it is broken in the halfway of pushing in to 3 mm. Those without breakage by 3 mm push in were evaluated as "excellent", and those generating a defect such as wrinkles and minute cracking without a trouble in terms of use for a magnetic core as "good". Moreover, the volume and the weight of a composite magnetic sheet having a certain size were measured for calculating the density and the void ratio from these values. Furthermore, for examining the characteristics of the composite magnetic sheet, a process was carried out as follows. First, the obtained composite magnetic sheet was punched out for a disc-like plate of about a 12 mm outer diameter and about a 6 mm inner diameter so that a coil of 30 turns (S1-UEW-0-30-NTL) was applied to the obtained plate-like test piece. With this provided as the test subject, the magnetic permeability (μ) was measured with the frequency changed using an impedance analyzer/gain phase analyzer.

C. Characteristic Evaluation Results of the Composite Magnetic Sheet and Discussion As shown in the table 1, the density and the magnetic permeability (μ) at 1 MHz of the composite magnetic sheet obtained in the example 1 were 3.4 g/cm$^3$ and 8.7, respectively. Moreover, the external appearance, the flexibility, the strength and the plane property of the sheet were "excellent".

The density and the magnetic permeability (μ) at 1 MHz of the composite magnetic sheet obtained in the example 2 were 3.8 g/cm$^3$ and 10.2, respectively. Moreover, the external appearance, the flexibility, the strength and the plane property of the sheet were all "excellent".

The density and the magnetic permeability (μ) at 1 MHz of the composite magnetic sheet obtained in the example 3 were 4.1 g/cm$^3$ and 11.5, respectively. Moreover, the external appearance, the flexibility, the strength and the plane property of the sheet were all "excellent".

The density and the magnetic permeability (μ) at 1 MHz of the composite magnetic sheet obtained in the example 4 were 4.8 g/cm$^3$ and 15.9, respectively. Moreover, the external appearance, the flexibility and the plane property of the sheet were "excellent". The strength of the sheet was "good".

The density and the magnetic permeability (μ) at 1 MHz of the composite magnetic sheet obtained in the example 5 were 4.9 g/cm$^3$ and 18.0, respectively. Moreover, the external appearance and the plane property of the sheet were "excellent". The flexibility and the strength of the sheet were "good".

The density and the magnetic permeability (μ) at 1 MHz of the composite magnetic sheet obtained in the example 6 were 4.2 g/cm$^3$ and 14.2, respectively. Moreover, the external appearance, the flexibility, the strength and the plane property of the sheet were all "excellent".

The density and the magnetic permeability (μ) at 1 MHz of the composite magnetic sheet obtained in the example 7 were 4.2 g/cm$^3$ and 15.8, respectively. Moreover, the external appearance, the flexibility, the strength and the plane property of the sheet were all "excellent".

The density and the magnetic permeability (μ) at 1 MHz of the composite magnetic sheet obtained in the example 8 were 4.5 g/cm$^3$ and 17.5, respectively. Moreover, the external appearance, the flexibility, the strength and the plane property of the sheet were all "excellent".

The density and the magnetic permeability (μ) at 1 MHz of the composite magnetic sheet obtained in the example 9 were 4.8 g/cm$^3$ and 18.3, respectively. Moreover, the external appearance, the flexibility, the strength and the plane property of the sheet were all "excellent".

The density and the magnetic permeability (μ) at 1 MHz of the composite magnetic sheet obtained in the example 10 were 5.0 g/cm$^3$ and 19.2, respectively. Moreover, the external appearance and the plane property of the sheet were "excellent". The flexibility and the strength of the sheet were "good".

The density and the magnetic permeability (μ) at 1 MHz of the composite magnetic sheet obtained in the comparative example 1 were 2.9 g/cm$^3$ and 5.1, respectively. Moreover, the external appearance, the flexibility, the strength and the plane property of the sheet were all "excellent".

The density and the magnetic permeability (μ) at 1 MHz of the composite magnetic sheet obtained in the comparative example 2 were 3.0 g/cm$^3$ and 5.1, respectively. Moreover, the external appearance, the flexibility, the strength and the plane property of the sheet were all "excellent".

As it is apparent from the above-mentioned, the values of the magnetic permeability (μ) and the density in the composite magnetic sheets produced in the conditions of the examples 1 to 5 are larger than the values of the magnetic permeability (μ) and the density in the comparative example 1. This is because the filling amount of the magnetic substance powders is low derived from the large value of the sum of the void volume occupation ratio generated by the volatilization at the time of the drying process and the binder volume occupation ratio in the composite magnetic sheet of the comparative example 1. That is, since the filling amount of the magnetic substance powders can be made larger in the composite magnetic sheets produced in the conditions of the examples 1 to 5 than the composite magnetic sheet of the comparative example 1, preferable characteristics results of dramatically improving the density and the magnetic permeability (μ) can be obtained. In particular, the composite magnetic sheets obtained in the conditions of the examples 2 and 3 have the excellent external appearance, flexibility, strength and plane property.

On the other hand, the composite magnetic sheet obtained in the conditions of the example 4 and the example 5 have a slightly low sheet strength, and in the case of the example 5, the sheet flexibility was slightly low as well. This is considered to be derived from a small PTFE powder amount of 3% by weight or less with respect to the composite magnetic sheet. From these results, as to the composite magnetic sheet composition ratio, it is preferable to provide the PTFE ratio with respect to the composite magnetic sheet of 7% by weight or more and 10% by weight or less.

The values of the magnetic permeability (μ) and the density in the composite magnetic sheets produced in the conditions of the examples 6 to 10 were larger than the values of the magnetic permeability (μ) and the density of the comparative example 2. It is conceivable that the residual gap in the molten binder as a mixture of a polyvinyl butylal based resin and an organic solvent, or the like used in the composite magnetic sheet of the comparative example 2 cannot be eliminated even by carrying out the re-pressure shaping, and as a result the filling amount of the magnetic substance powders cannot be increased.

Moreover, as it is apparent from the comparison of the examples 6 to 10 and the examples 1 to 5, even in the case of using the magnetic substance powders and the PTFE powders of the same composition, it is learned that the residual air reservoir in the composite magnetic sheet can be reduced by about 36% at most by adopting the re-pressure shaping process. That is, for a composite magnetic sheet with a lower magnetic substance powder mixing ratio, the density and the magnetic permeability (μ) can be improved effectively by carrying out the re-pressure shaping process. This is greatly advantageous in that even in the case that the density or the magnetic permeability (μ) of the composite magnetic sheet according to the present invention is off a desired value by any chance, it can be adjusted to the desired value by an extremely simple measure of carrying out the re-pressure shaping by a pressing machine.

The present invention can be utilized in the industry of producing or using a composite magnetic sheet.

What is claimed is:

1. A production method for a composite magnetic sheet, comprising: a dry powder mixing process of mixing magnetic substance powders and polytetrafluoroethylene without using a solvent; and a pressure shaping process comprising shaping the mixed powder after the powder mixing process by pressuring; wherein the mixed powder is pressured with adding the shearing force by two rollers; and relatively adjusting the rotational rate of one of the rolling rollers and the rotational rate of the other rolling roller in the pressure shaping process.

2. The production method for a composite magnetic sheet of claim 1, further comprising: a re-pressure shaping process comprising pressuring again the composite magnetic sheet after the pressure shaping process.

* * * * *